US009334722B1

(12) United States Patent
Taher

(10) Patent No.: US 9,334,722 B1
(45) Date of Patent: May 10, 2016

(54) DYNAMIC OIL AND NATURAL GAS GRID PRODUCTION SYSTEM

(71) Applicant: Mubarak Shater M. Taher, Safat (KW)

(72) Inventor: Mubarak Shater M. Taher, Safat (KW)

( * ) Notice: Subject to any disclaimer, the term of this patent is extended or adjusted under 35 U.S.C. 154(b) by 0 days.

(21) Appl. No.: 14/945,373

(22) Filed: Nov. 18, 2015

(51) Int. Cl.

| | |
|---|---|
| ***E21B 43/34*** | (2006.01) |
| ***E21B 43/30*** | (2006.01) |
| ***E21B 21/06*** | (2006.01) |
| *C10G 7/02* | (2006.01) |
| *C10G 7/12* | (2006.01) |
| *C10G 7/04* | (2006.01) |

(52) U.S. Cl.
CPC ..... *E21B 43/34* (2013.01); *E21B 21/063* (2013.01); *E21B 43/30* (2013.01); *C10G 7/02* (2013.01); *C10G 7/04* (2013.01); *C10G 7/12* (2013.01)

(58) Field of Classification Search
CPC ..... E21B 21/06; E21B 21/063; E21B 21/067; E21B 43/34; E21B 43/30
See application file for complete search history.

(56) References Cited

U.S. PATENT DOCUMENTS

| | | | | | |
|---|---|---|---|---|---|
| 2,773,556 | A | * | 12/1956 | Banks | C10G 7/00 137/115.25 |
| 2,810,263 | A | | 10/1957 | Raymond | |
| 3,001,604 | A | * | 9/1961 | Worley | C10G 33/06 159/DIG. 33 |
| 3,098,523 | A | * | 7/1963 | Meyers | E21B 43/34 166/319 |
| 3,219,107 | A | * | 11/1965 | Brown, Jr. | E21B 43/36 166/250.15 |
| 3,246,451 | A | * | 4/1966 | Glasgow | G05D 9/00 137/202 |
| 3,366,173 | A | * | 1/1968 | McIntosh | E21B 43/017 166/356 |
| 3,504,741 | A | * | 4/1970 | Talley, Jr. | E21B 43/017 166/267 |
| 3,616,399 | A | * | 10/1971 | Smith | C10G 33/06 208/188 |
| 3,704,567 | A | * | 12/1972 | Engel | E21B 43/34 95/19 |
| 3,856,677 | A | * | 12/1974 | Peters | B01D 17/02 210/105 |
| 3,970,143 | A | * | 7/1976 | Thrash | E21B 36/006 166/53 |
| 4,233,154 | A | * | 11/1980 | Presley | B01D 17/0214 166/267 |
| 4,305,463 | A | * | 12/1981 | Zakiewicz | E21B 33/138 166/245 |
| 4,466,885 | A | | 8/1984 | Ronden | |
| 4,597,437 | A | * | 7/1986 | McNabb | E21B 43/34 166/79.1 |

(Continued)

FOREIGN PATENT DOCUMENTS

| | | | |
|---|---|---|---|
| CN | 201247230 | Y | 5/2009 |
| DE | 197 26 000 | A1 | 11/1998 |

*Primary Examiner* — Jennifer H Gay
(74) *Attorney, Agent, or Firm* — Richard C. Litman

(57) ABSTRACT

The dynamic oil and natural gas grid production system includes a plurality of "mini" or localized gathering centers for receiving crude oil from a plurality of remote oil wells. Each of the plurality of localized gathering centers includes a heat exchanger for receiving and heating the crude oil, an oil-gas separator in communication with the heat exchanger for separating the crude oil into natural gas and secondary oil, and a three-way separator in communication with the oil-gas separator for receiving the secondary oil and separating the secondary oil into tertiary oil and effluent water. First, second and third flow lines are in communication with each of the plurality of gathering centers for receiving and transporting the natural gas, effluent water and tertiary oil to a centralized gathering center.

13 Claims, 3 Drawing Sheets

(56) References Cited

U.S. PATENT DOCUMENTS 5,127,231 A * 7/1992 Larue ..... E21B 43/34 62/633
6,561,041 B1 * 5/2003 Eck ..... E21B 47/10 73/861.04
7,467,540 B2 12/2008 Kriel
7,621,324 B2 * 11/2009 Atencio ..... E21B 34/00 166/250.15
9,187,996 B1 * 11/2015 Nevison ..... E21B 43/26
2005/0082473 A1 4/2005 Socki et al.
2006/0272503 A1 * 12/2006 Adam ..... B01D 17/0214 95/253
2007/0125543 A1 * 6/2007 McNeel ..... E21B 43/25 166/308.3
2008/0290719 A1 * 11/2008 Kaminsky ..... C01B 3/22 299/3
2010/0206560 A1 * 8/2010 Atencio ..... E21B 34/00 166/250.15
2011/0011157 A1 1/2011 Bourlon et al.
2013/0106117 A1 * 5/2013 Sites ..... F01K 23/10 290/1 R
2013/0304393 A1 11/2013 Sutan
2014/0013735 A1 1/2014 McBride et al.
2014/0200936 A1 7/2014 Alphenaar et al.
2015/0007981 A1 * 1/2015 Shomody ..... E21B 36/00 166/245
2015/0306520 A1 * 10/2015 Grave ..... B01D 17/04 166/335

* cited by examiner

DYNAMIC OIL AND NATURAL GAS GRID PRODUCTION SYSTEM

BACKGROUND OF THE INVENTION

1. Field of the Invention

The present invention relates to the production of oil and gas, and particularly to an integrated system and method for producing oil and gas, where crude oil is separated into oil, natural gas and effluent water at a plurality of remote locations, and where each component is delivered to a centralized location.

2. Description of the Related Art

Throughout the years, different strategies have been adapted to increase the production of crude oil. An example of one such strategy is to build and maintain centralized gathering centers including booster stations and effluent water handling facilities to produce useable oil, natural gas and water. Such strategies, however, face a myriad of technical challenges and other associated difficulties that can make them very costly.

Prior strategies, for example, have failed to efficiently produce crude oil from oil wells having different characteristics (e.g. high pressure vs. low pressure, high gas content vs. low gas content, high water cut vs. low water cut, etc). Another challenge relates to the distance between the centralized gathering center and the various oil wells. For example, since oil wells typically are not positioned in close proximity to the centralized gathering center, flow line congestion can often result. Also, the relatively long distances between the remote oil wells and the centralized gathering center, as well as the relatively low pressure in the respective oil wells, require the use and operation of multiple electrical submersible pumps to maintain a constant flow of oil. Further, a large amount of heat energy and pressure is typically wasted due to the large distances that the oil needs to travel from each of the oil wells to the centralized gathering center.

Other problems associated with prior strategies involving a centralized gathering center relate to inefficient treatment of various gases and the effluent water produced during the extraction of crude oil. For example, hydrogen sulfide ($H_2S$), a highly corrosive gas associated with the production of crude oil can adversely affect ones' health and safety, as well as the environment. These gases must be removed from the system and directed to appropriate facilities. Further, it is to be noted that the effluent water produced, in addition to the gases, can take up valuable space within the pipeline(s), thus, not only reducing the amount of crude oil that can be produced, but also adversely affecting the smooth operation of the centralized gathering center; thereby requiring additional resources to enhance the quality and efficiency of crude oil production.

Shutting down a centralized gathering center for planned, as well as unplanned, maintenance in the past has been typically very labor intensive and cost intensive. Further, taking the centralized gathering center offline for maintenance can cause substantial production losses. Security and land requirements for current and future sites can also raise significant issues since centralized gathering center(s) normally take up a significant amount of space.

Thus, a dynamic centralized oil and natural gas grid production system solving the aforementioned problems is desired.

SUMMARY OF THE INVENTION

The dynamic oil and natural gas grid production system includes a plurality of "mini" or localized gathering centers, located remotely from a centralized location, with each localized gathering center being in communication with a remote oil well for receiving crude oil therefrom. The "mini" gathering centers can be portable or easily shifted from place to place. Each of the plurality of localized gathering centers is configured to collect crude oil from a different well and test characteristics of the well. Each of the plurality of localized gathering centers includes a heat exchanger for receiving and heating the crude oil, and a three-way separator for separating natural gas, oil, and water into different streams. The "mini" gathering center can be powered by gas turbine, expanders, or by unconventional ways such as solar energy or geothermal energy.

A circular flow line assembly is provided, having first, second and third flow lines, where each of the first, second and third flow lines is in fluid communication with each of the plurality of gathering centers. Each flow line can be pipelines having a diameter of about 36 inches or more. The first flow line is adapted for receiving the natural gas separated from the crude oil, the second flow line is adapted for receiving the effluent water separated from the secondary oil, and the third flow line is adapted for receiving the tertiary oil. A centralized gathering center is in fluid communication with the first, second and third flow lines for respectively receiving the natural gas, the effluent water and the tertiary oil. It is to be noted that the assembly can be modified so as to enhance the quality of oil production. The entire system can, for example, be operable with 24 volts.

It is an object to the present invention to provide a flexible system that can be easily modified to account for various different configurations and types of oil wells.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
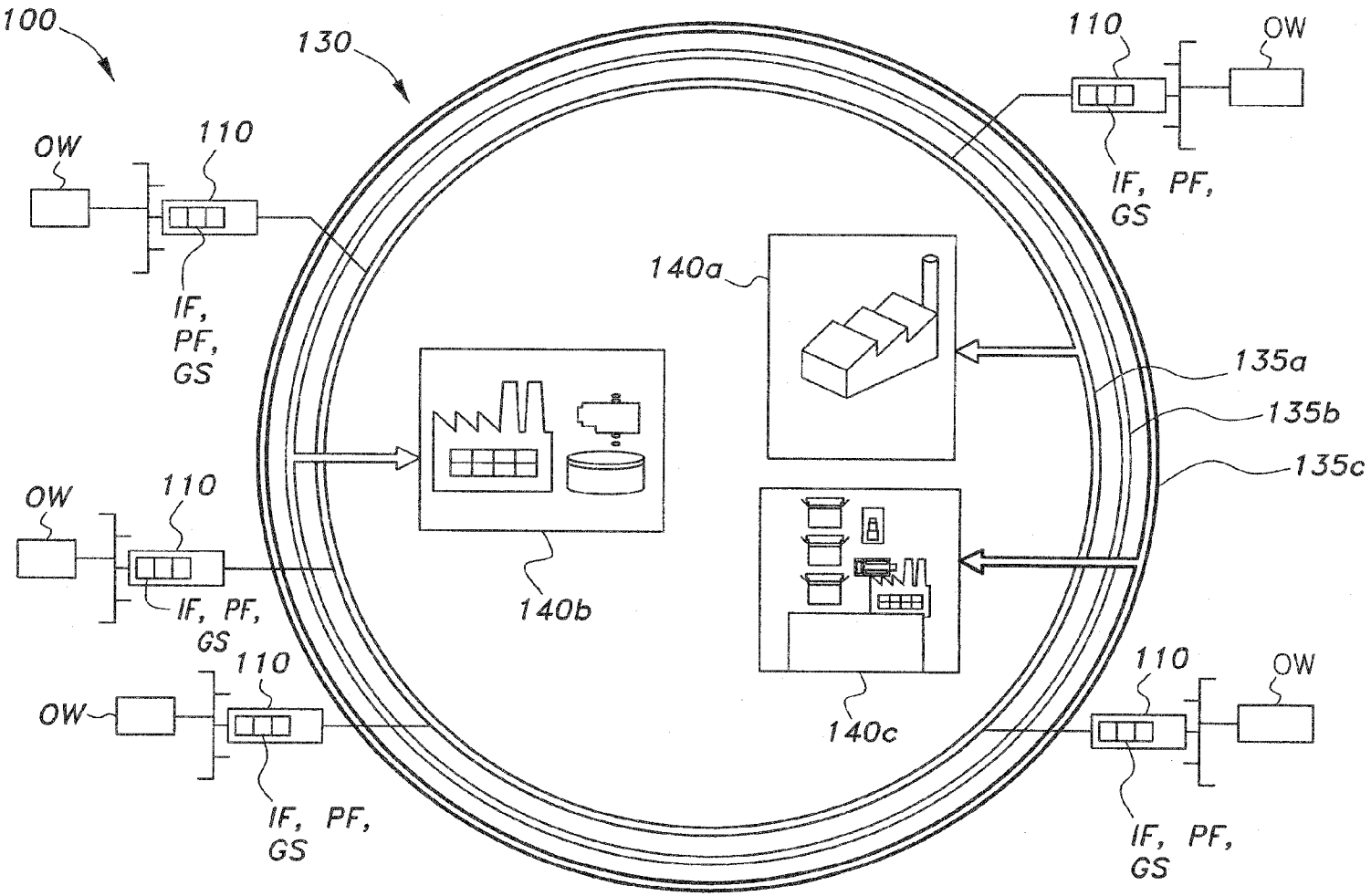
FIG. 1 is an environmental view of a dynamic oil and natural gas grid production system, according to the present invention.
Figure 2:
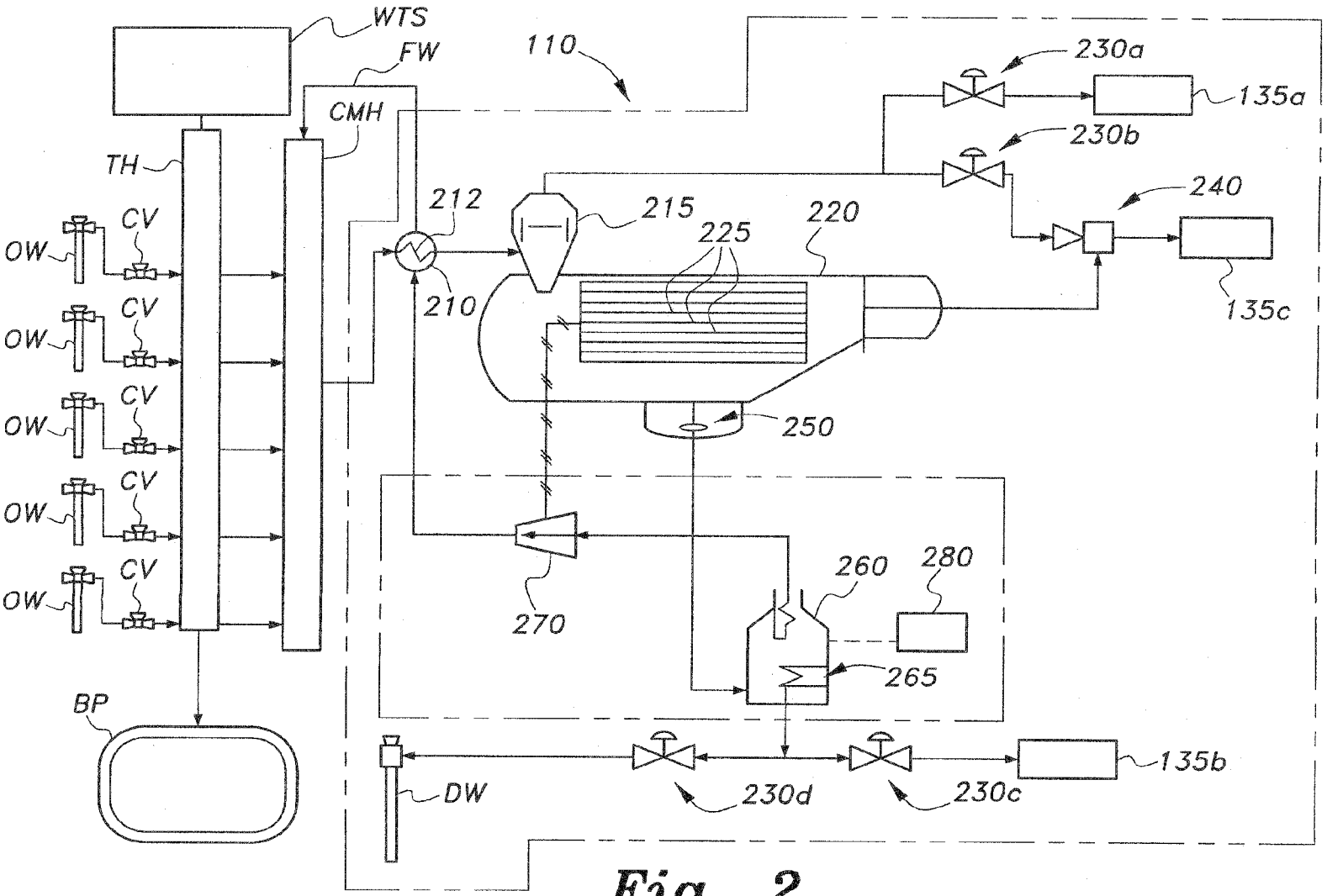
FIG. 2 is a diagrammatical illustration of a "mini" or localized gathering center for a dynamic oil and natural gas grid production system, according to the present invention.
Figure 3:
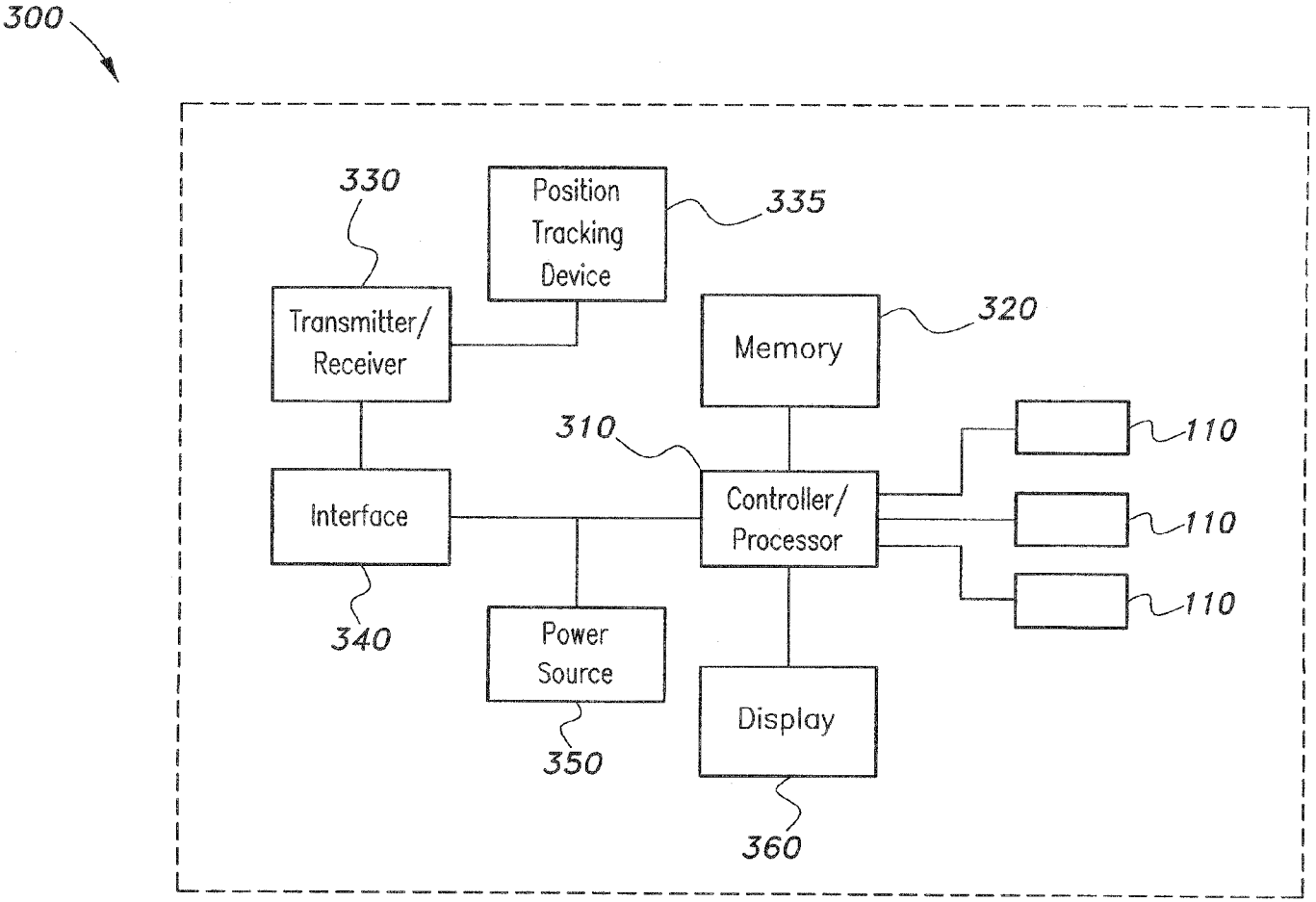
FIG. 3 is a block diagram showing system components of a dynamic oil and natural gas grid production system, according to the present invention.

Referring to FIGS. 1-3, a dynamic oil and natural gas grid production system 100 is generally illustrated. The system 100 is an integrated system having a plurality of "mini" or localized gathering centers 110, in which each of the "mini" gathering centers 110 is configured for receiving crude oil from a corresponding oil well OW and for separating the crude oil into oil, natural gas and effluent water. As such, the system 100 can be expanded or contracted by adding or subtracting localized gathering centers 110. The centralized oil and natural gas production system 100, as best shown in FIG. 1, further includes a circular flow line assembly 130, including a plurality of flow lines, such as a first flow line 135*a* configured for receiving and/or storing natural gas, a second flow line 135*b* configured for receiving and/or storing effluent water, and a third flow line 135*c* configured for receiving and/or storing oil. Each of the plurality of flow lines 135*a*-135*c* preferably has a diameter of at least 36 inches and can stabilize the incoming crude oil. Further, the circular flow line assembly 130 can be constructed as an underground circular pipeline in which each of the plurality of flow lines, such as flow lines 135*a*-135*c*, circle the production field area. The system 100 can also include a control system 300, such as a wireless control system, configured for controlling the system 100.

Each of the plurality of "mini" gathering stations 110 can be positioned in communicating relation to each of the plurality of flow lines 135*a*-135*c*, as illustrated in FIG. 1, so as to transfer natural gas, effluent water, and oil into the respective flow line 135*a*-135*c*. Further, as shown in FIG. 2, each of the plurality of "mini" gathering stations 110 can include a heat exchanger 210, an oil-natural gas separator 215, a three-way separator 220 having a plurality of electro-static electrodes 225, a boiler 260 having a fixed heating element 265, a boiler power source 280 configured for heating the fixed heating element 265 positioned inside the boiler 260, and a turbine 270, such as a steam electrical generator, so as to power each of the plurality of "mini" gathering centers 110. Each of the plurality of "mini" gathering centers 110 can also be powered through gas pressure, solar/diesel generators, as well as through geothermal energy or any other suitable power source.

Each of the plurality of "mini" gathering centers 110 can also include a plurality of gate valves, such as a first gate valve 230*a*, a second gate valve 230*b*, a third gate valve 230*c*, and a fourth gate valve 230*d*, each of which may be a pneumatic valve or the like. It should be understood that the plurality of gate valves 230*a* and 230*b* may be any suitable type of gate valve that can be configured for regulating the flow of natural gas, oil, and effluent water into the respective flow line 135*a*-135*c* of the circular flow line assembly 130. Further, it is to be noted that each of the plurality of "mini" gathering centers 110 can be constructed as portable units, such as those adapted to fit onto a mid-size load truck so as to provide the freedom of movement within a vast oil field, for example, as may be required.

Further, each of the plurality of "mini" gathering stations 110 can also include an inspection facility IF from which personnel, such as engineers, can inspect the quality of the natural gas, oil, and water being separated from the crude oil, at least one gas scrubber GS configured for removing particulates and/or gases from any exhaust, and a pigging facility PF configured for launching and recovering "pigs" adapted to clean the inner walls of the plurality of flow lines 135*a*-135*c*. It is to be noted that the "pigs" can also be configured for monitoring and detecting critical conditions, such as cracks, corrosion, or pipe deformation, which can compromise the integrity of the flow lines 135*a*-135*c*.

The heat exchanger 210 can be positioned in communicating relation with a crude main header CMH, which can, in turn, be positioned in communicating relation to a test header TH. The test header TH is positioned in communicating relation to the plurality of oil wells OW (typically on the order of approximately 5,000) so as to receive crude oil from the plurality of oil wells OW. Each of the plurality of oil wells OW can be equipped with a check valve CV that can be configured to regulate the flow of crude oil into the test header TH. The test header TH can also be positioned in communicating relation to a well testing system WTS that can be configured to operate in conjunction with a Supervisory Control and Data Acquisition system. The test header TH, the crude main header CMH, and the well testing system WTS can be configured for determining the various substances present in the crude oil received from the plurality of oil wells OW. The crude main header CMH can also be configured for receiving fresh water FW from the heat exchanger 210. Further, the test header TH can be positioned in communicating relation to a burn pit BP configured for eliminating excess gasses, such as by burning the excess gasses produced in the plurality of oil wells OW. It is to be noted that the heat exchanger 210 can be any suitable type of heat exchanger configured for heating the crude oil received from the crude main header CMH to a suitable temperature so as to enhance the natural gas, effluent water, and crude oil separation such as in the oil-natural gas separator 215.

The oil-natural gas separator 215 can be any suitable type of oil-natural gas separator capable of separating oil and natural gas. Further, the oil-natural gas separator 215 can be positioned in communicating relation to the heat exchanger 210 so as to receive heated crude oil from a tube 212 positioned within the heat exchanger 210. The oil-natural gas separator 215 can also be positioned in communicating relation to the three-way separator 220, so as to transfer the oil into the three-way separator 220, as well as in communicating relation to the flow line 135*a*, as illustrated in FIG. 2, so as to transfer natural gas into the flow line 135*a*.

The three-way separator 220 can be any suitable type of three-way separator configured to separate effluent water, such as saltwater, from the oil received from the oil-natural gas separator 215. For example, the natural gas can be separated from the top, the oil can be separated from the mid-section, and the effluent water can be separated from the bottom after passing through the three-way separator 220. The three-way separator 220 can be also include a desalination system (not shown) and at least one opening 250 configured for allowing effluent water to pass from the three-way separator 220 into the boiler 260. Further, the three-way separator 220 can be positioned in communicating relation to the flow line 135*c*, as illustrated in FIG. 2, so as to transfer oil into the flow line 135*c*.

The boiler 260 can be any suitable boiler configured for evaporating a portion of the effluent water received from the three-phase separator 220. The boiler 260 can be positioned in communicating relation to the turbine 270, as well as in communicating relation to a disposal well DW and the flow line 135*b*, which is configured for receiving and/or storing effluent water. The steam generated in the boiler 260 can be utilized to power the turbine 270, which, in turn, can be utilized to provide electricity to the plurality of electro-static electrodes 225 positioned in the three-way separator 220. The portion of the effluent water that is not evaporated can either be discharged into the disposal well DW or into the flow line 135*b* configured to store effluent water.

FIG. 3 illustrates a control system 300, such as a wireless control system, for implementing operation of system 100. The control system 300 can represent, for example, a standalone computer, computer terminal, portable computing device, networked computer or a computer terminal, or networked portable device, and can also include a microcontroller, an application specific integrated circuit (ASIC), or a programmable logic controller (PLC). Further, the control system 300 can be equipped with a WiMax communication system.

Data can be entered into the control system 300 by the user, or sent or received from or by any suitable type of interface 340, such as a remote control, as can be associated with a transmitter/receiver 330, such as for wireless transmission/reception or for wireless communication. The transmitter/receiver 330 can be associated with a position tracking device 335, such as can send and receive signals as to a location of each of the plurality of "mini" gathering centers 110. For example, the position tracking device 335 can be associated with a global positioning system (GPS) device, so as to provide information as to a position or location of the plurality of "mini" gathering centers 110.

The transmitter/receiver 330 can send or receive data or control signals such as sent or received by or from a remote control device (not shown). The control system 300 can also include a memory 320 such as to store data and information, as well as program(s) or instructions for implementing operation of each of the plurality of "mini" gathering centers 110. The memory 320 can be any suitable type of computer readable and programmable memory, such as non-transitory computer readable media, random access memory (RAM) or read only memory (ROM), for example. The system 300 can also be powered by a power source 350, such as a battery.

Calculations, determinations, data transmission or data reception, sending or receiving of control signals or commands, such as in relation to opening and closing the plurality of gated valves 230*a*-230*d*, providing information to each of the plurality of "mini" gathering stations, or regulating the flow of oil, natural gas, or effluent water in the respective one of the plurality of flow lines 135*a*-135*c*, are performed or executed by a controller/processor 310 of the generalized system 300. The controller/processor 310 can be any suitable type of computer processor, such as a microprocessor or an ASIC, and the calculations, determinations, data transmission or data reception, sending or receiving of control signals or commands processed or controlled by the controller/processor 310 can be displayed to the user of the system 100 on a display 360, which can be any suitable type of computer display, such as a light emitting diode (LED) or liquid crystal display (LCD), for example.

The controller/processor 310 can be associated with, or incorporated into, any suitable type of computing device, for example, a personal computer or a PLC. The display 360, the interface 340, the controller/processor 310, the transmitter/receiver 330, the position tracking device 335, the memory 320, and any associated computer readable media are in communication with one another by any suitable type of data bus, as is well known in the art.

By way of operation, crude oil is drawn from the plurality of oil wells OW into the test header TH where the substances contained in the crude oil can be determined. While the crude oil is being injected into the crude main header CMH, the excess gasses produced in the plurality of oil wells can be eliminated, such as by being burned off in the burn pit BP. After the crude oil has been tested in the test header TH and the excess gasses burned off in the burning pit BP, the crude oil can be injected into the crude main header CMH, where it is funneled through the tube 212 into the heat exchanger 210.

In the heat exchanger 210, the crude oil can be heated to a suitable temperature so that oil and natural gas can be separated in the oil-natural gas separator 215 positioned in communicating relation to the heat exchanger 212. Once the natural gas is separated from the oil, the natural gas, such as high pressure natural gas and low pressure natural gas, can be injected into the flow line 135*a*. Once in the flow line 135*a*, the natural gas can be transferred into a centralized gathering station, such as centralized gathering station 140*a*, such as a gas booster station, where it can be sufficiently pressurized so that it can be transferred from one location to another. It is to be noted that the natural gas can also be compressed via a compressor 240 so as to aid in the transfer of oil into flow line 135*c*. It is to be noted that for the natural gas to be injected into the flow line 135*a*, the gate valve 230*a* should remain open and the gate valve 230*b* should remain closed. However, if the natural gas is to be compressed so as to aid in the transfer of oil, the gate valve 230*a* should remain closed and the gate valve 230*b* should remain open.

Once the natural gas has been separated from the oil, the oil is deposited into the three-way separator 220 positioned in communicating relation to the oil-natural gas separator 215. While in the three-way separator 220 the plurality of electrostatic electrodes 225 can separate the effluent water from the oil. Once the oil is separated from the effluent water, the oil can be transferred into the flow line 135*c*, where the oil can be refined and transferred into a centralized gathering station, such as centralized gathering station 140*c*, where the oil can be distributed for use by individuals and/or corporations.

After the plurality of electro-static electrodes 225 separate the oil from the effluent water and the effluent water passes through the desalination unit (not shown) configured for removing, such as substantially removing, salt from the effluent water, the effluent water is discharged through the opening 250 into the boiler 260 having the heating element 265 configured for generating sufficient heat so as to evaporate a portion of the effluent water received from the three phase separator 220. For example, the effluent water can be discharged into the boiler 260, as illustrated in FIG. 2, where a portion of the effluent water can be converted into steam, such as by evaporation. The steam generated in the boiler 260 can be utilized to power the turbine 270, which, in turn, can be utilized to provide electricity to the plurality of electro-static electrodes 225 in the three-way separator 220.

Further, the steam used to power the turbine 270 can be injected into the heat exchanger 210 so as to heat the tube 212 through which the crude oil passes into the heat exchanger, such as by condensation. In other words, as the steam makes contact with the tube 212 used to transport the crude oil, the steam condenses and turns into fresh water FW that can be transferred into the crude main header CMH, thereby, transferring the heat in the steam to the crude oil and, in essence, heating the crude oil prior to the crude oil entering the oil natural gas separator 215.

The portion of the effluent water that does not evaporate in the boiler 260 can either be discharged into the disposal well DW or into the flow line 135*b* configured for receiving and/or storing effluent water. For the effluent water to be discharged into the disposal well DW the gate valve 230*c* should be closed and the gate valve 230*d* should be opened and for the effluent water to be discharged into the flow line 135*b*, the gate valve 230*d* should be closed and the gate valve 230*c* should be opened. The effluent water can be transferred to the centralized gathering center 140*b* where it can be treated and cleaned, such as substantially cleaned, of impurities to be used as drinking water. The effluent water flowing through the third flow line 135*b* can also be used to generate hydraulic power to power the system 100 or can be utilized for hydraulic fracking in which the effluent water can be injected into the ground so as to break up shale rocks to release natural gas.

It is to be understood that the present invention is not limited to the embodiments described above, but encompasses any and all embodiments within the scope of the following claims.

I claim:

1. A dynamic oil and natural gas grid production system, comprising:

a plurality of localized gathering centers, each of the plurality of localized gathering centers comprising:

a heat exchanger for receiving and heating crude oil;

an oil-gas separator in communication with said heat exchanger for separating the crude oil into natural gas and secondary oil; and a three-way separator in communication with said oil-gas separator for receiving the secondary oil and separating the secondary oil into tertiary oil and effluent water;

a circular flow line assembly having first, second and third flow lines, each of the first, second and third flow lines being in fluid communication with each of the plurality of gathering centers, the first flow line being adapted for receiving the natural gas separated from the crude oil, the second flow line being adapted for receiving the effluent water separated from the secondary oil, and the third flow line being adapted for receiving the tertiary oil;

wherein the circular flow assembly provides a transport conduit and a fluid storage reservoir for each of fluids in each respective flow line; and a centralized gathering center in fluid communication with the first, second and third flow lines for respectively receiving the natural gas, the effluent water and the tertiary oil.

2. The dynamic oil and natural gas grid production system according to claim 1, further comprising a control system.

3. The dynamic oil and natural gas grid production system according to claim 2, wherein the control system comprises a wireless control system.

4. The dynamic oil and natural gas grid production system according to claim 1, wherein each of the plurality of localized gathering centers further comprises a boiler having a heating element, the boiler being in fluid communication with the three-way separator for receiving and heating the effluent water.

5. The dynamic oil and natural gas grid production system according to claim 4, wherein each of the plurality of localized gathering centers further comprises a boiler power source.

6. The dynamic oil and natural gas grid production system according to claim 5, wherein each of the plurality of localized gathering centers further comprises a turbine configured for generating power for the oil-gas separator, the turbine being driven by steam produced by the boiler.

7. The dynamic oil and natural gas grid production system according to claim 1, wherein each of the plurality of localized gathering centers further comprises first, second and third gate valves for selectively controlling flow through the first, second and third flow lines.

8. A dynamic oil and natural gas grid production system, comprising:

a plurality of localized gathering centers, each of the plurality of localized gathering centers comprising:

a heat exchanger for receiving and heating crude oil;

an oil-gas separator in communication with said heat exchanger for separating the crude oil into natural gas and secondary oil;

a three-way separator in communication with said oil-gas separator for receiving the secondary oil and separating the secondary oil into tertiary oil and effluent water; and a boiler having a heating element, the boiler being in fluid communication with the three-way separator for receiving and heating the effluent water;

a circular flow line assembly having first, second and third flow lines, each of the first, second and third flow lines being in fluid communication with each of the plurality of gathering centers, the first flow line being adapted for receiving the natural gas separated from the crude oil, the second flow line being adapted for receiving the effluent water separated from the secondary oil, and the third flow line being adapted for receiving the tertiary oil;

wherein the circular flow assembly provides a transport conduit and a fluid storage reservoir for each of fluids in each respective flow line; and a centralized gathering center in fluid communication with the first, second and third flow lines for respectively receiving the natural gas, the effluent water and the tertiary oil.

9. The dynamic oil and natural gas grid production system according to claim 8, further comprising a control system.

10. The dynamic oil and natural gas grid production system according to claim 9, wherein the control system comprises a wireless control system.

11. The dynamic oil and natural gas grid production system according to claim 8, wherein each of the plurality of localized gathering centers further comprises a boiler power source.

12. The dynamic oil and natural gas grid production system according to claim 11, wherein each of the plurality of localized gathering centers further comprises a turbine configured for generating power for the oil-gas separator, the turbine being driven by steam produced by the boiler.

13. The dynamic oil and natural gas grid production system according to claim 8, wherein each of the plurality of localized gathering centers further comprises first, second and third gate valves for selectively controlling flow through the first, second and third flow lines.

* * * * *